US005394624A

United States Patent [19]

Siepser

[11] Patent Number: 5,394,624

[45] Date of Patent: Mar. 7, 1995

[54] DISPOSABLE SURGICAL FOOT COVERING

[76] Inventor: Steven B. Siepser, 866 Downingtown Pike, West Chester, Pa. 19380

[21] Appl. No.: 218,982

[22] Filed: Mar. 28, 1994

Related U.S. Application Data

[63] Continuation of Ser. No. 79,744, Jun. 21, 1993, abandoned, which is a continuation of Ser. No. 867,441, Apr. 13, 1992, abandoned.

[51] Int. Cl.[6] ..... A43B 1/02

[52] U.S. Cl. ..... 36/9 R; 36/84

[58] Field of Search ..... 36/9 R, 7.1 R, 10, 7.7, 36/8.1, 8.2, 11, 9 A, 110

[56] References Cited

U.S. PATENT DOCUMENTS

| | | | |
|---|---|---|---|
| 2,229,575 | 1/1941 | Kaplan | 36/8.1 |
| 2,327,415 | 8/1943 | Forschner | 36/9 R |
| 2,334,659 | 11/1943 | Van Arsdale et al. | 36/9 R |
| 2,679,117 | 5/1954 | Reed | 36/9 R |
| 2,798,311 | 7/1957 | Scholl | 36/10 |
| 2,845,723 | 8/1958 | Arnold | 36/9 R |
| 3,798,503 | 3/1974 | Larsh et al. | 36/9 R X |
| 4,023,281 | 5/1977 | Terry | 36/7.1 R |
| 4,083,124 | 4/1978 | Michalak | 36/7.1 R |
| 4,272,859 | 7/1981 | Vanhove | 36/7.1 R X |
| 4,301,603 | 11/1981 | Scott | 36/8.1 X |
| 4,550,446 | 11/1985 | Herman | 2/239 |
| 4,616,428 | 10/1986 | Leger | 36/7.1 R |
| 4,809,447 | 3/1989 | Pacanowsky | 36/9 R |
| 4,899,412 | 2/1990 | Ganon | 36/9 R X |

FOREIGN PATENT DOCUMENTS

| | | | |
|---|---|---|---|
| 2502912 | 10/1982 | France | 36/7.1 R |

*Primary Examiner*—Paul T. Sewell
*Assistant Examiner*—Ted Kavanaugh
*Attorney, Agent, or Firm*—Woodcock Washburn Kurtz Mackiewicz & Norris

[57] ABSTRACT

A protective foot covering for use primarily in hospital operating rooms by surgeons requiring use of surgical instruments having foot controls. The covering comprises an upper formed of a non-woven crepe material which is resistant to penetration by liquids. The sole is formed by three separate material layers; the outermost layer being formed from a water-proof plastic material, the middle layer being formed from a non-woven fabric material and the innermost layer being formed from absorbent terrycloth. The sole layers provide a cushioned protection against slippage, water penetration and piercing from sharp objects on the operating room floor while also allowing the required sensitivity between the surgeon's foot and the foot controls of the surgical instrument.

3 Claims, 1 Drawing Sheet

DISPOSABLE SURGICAL FOOT COVERING

REFERENCE TO RELATED APPLICATION

This is a continuation, of application Ser. No. 08/079,744, filed Jun. 21, 1993, now abandoned, which is a continuation of application Ser. No. 867,441, filed on Apr. 13, 1992, now abandoned.

BACKGROUND OF THE INVENTION

This invention relates to foot coverings and, more particularly, to a disposable surgical foot covering which may be worn over the bare foot during surgical procedures requiring use of foot controls.

Foot coverings which are disposable have been in wide use in hospitals for many years. They are desirable since they are very cheap to manufacture, are sanitary and may be disposed of after each use, thereby reducing chances of contamination and spread of disease.

Foot coverings of the above type are typically formed of a non-woven paper type material and are susceptible to tearing. They also do not protect well against water or other liquids penetrating the foot covering. For doctors in the operating room, the foot coverings are usually placed over the doctor's own street shoes. There are certain surgical procedures, however, which require the use of sensitive foot controls where the surgeon cannot wear conventional street shoes. The surgeon needs to rely on the feel of the foot controls on the sole of his own foot to operate effectively and safely.

Many times the same surgical procedures requiring operation of foot controls also require use of liquid solutions for application to the patient, an example of such surgery being ophthalmic surgery on the eye. The liquid solutions usually run off the patient and onto the operating floor and, many times, onto the surgeon's own feet. Surgeons have reported the lack of an effective foot covering which provides protection against liquids and other hazards on the operating floor while still maintaining good foot sensitivity while operating surgical foot controls.

It is therefore a principle object of the present invention to provide a disposable surgical foot covering which a surgeon may wear over his bare feet in the operating room during surgical procedures involving the use of foot controls.

It is a further object of the present invention to provide a disposable surgical foot covering which provides protection against water or other liquids reaching the surgeon's foot through the foot covering.

It is another object of the present invention to provide a disposable surgical foot covering which provides limited protection from broken glass on the operating room floor piercing the covering and injuring the foot.

It is yet another object of the present invention to provide a disposable surgical foot covering which provides maximum comfort while maintaining good sensitivity between the surgeon's foot and the foot controls of surgical operating equipment.

It is-still a further object to provide a disposable surgical foot covering having the above mentioned characteristics which is relatively simple in design such that it may be manufactured and sold at a reasonable cost and which is otherwise economically attractive.

Other objects will in part be obvious and in part appear hereinafter.

SUMMARY OF THE INVENTION

In accordance with the foregoing objects, the present invention provides a novel and improved disposable surgical foot covering which is comprised of a sole having three distinct plies, and an upper comprised of a single ply of material sewn around the perimeter of the sole. The new and improved surgical foot covering is simple and economical to manufacture, easy to put on and remove, protective, comfortable and it provides the amount of sensitivity necessary for surgeons using foot controls.

The sole is formed from three distinct fabric layers providing a cushioned, comfortable, flexible sole. The outermost layer, which is in contact with the floor, is cut from flexible, reinforced plastic which is highly resistant to tearing, waterproof, and provides a surgeon with the surefootedness he/she needs. The middle ply is cut or otherwise formed from non-woven cotton or cotton-type synthetic material which is highly porous, and it also cushions a surgeon's feet while he/she is walking or standing. The third, inner-most ply, with which the bottom of the foot makes contact when the foot covering is worn, is cut from terrycloth, which provides a surgeon's foot with the soft, absorbent, comfortable material desired.

The entire upper is formed from a single piece of non-woven fabric. The upper is sewn around the perimeter of the sole and is provided with a top opening for passage of a foot therethrough. A strip of elastic is sewn to the inside of the opening to allow for a snug fit to any size ankle. A second strip of elastic is sewn on the inside of the foot covering, laterally across the toe portion. This keeps the foot covering fairly tight to the foot so that the foot covering doesn't cause any mishaps. The non-woven fabric from which the upper is formed is very soft so as not to irritate the foot; is water resistent so water will not seep through and cause any discomfort to the surgeon; is porous to allow the foot to breathe properly and reduce sweating; and is reasonably durable to endure any shearing or tearing forces that it may undergo while in use.

Since the foot covering is formed from the aforementioned inexpensive materials, and requires such simple stitching, this foot covering is very easy and inexpensive to manufacture. This fact coupled with all other advantages and features discussed above, make the present invention better and more desirable than any previous disposable surgical foot covering.

DETAILED DESCRIPTION

Figure 1:
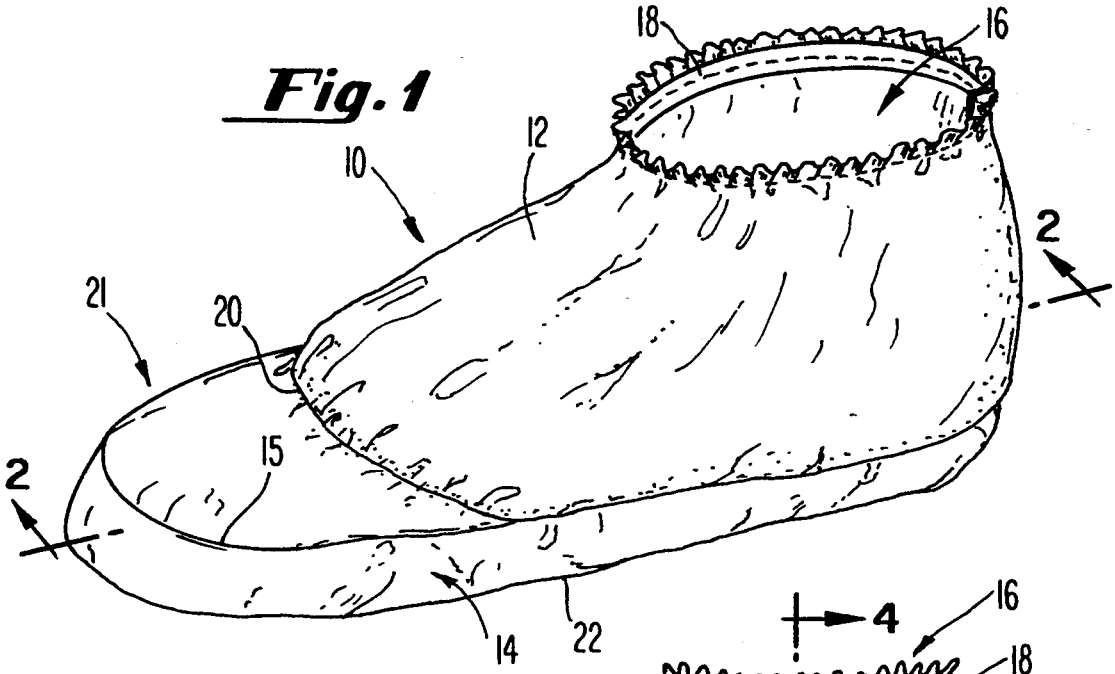
FIG. 1 is a perspective of a surgical foot covering constructed in accordance with the present invention.

Referring now to the drawings, the embodiment of the present invention, hereinafter the "surgical foot covering" or simply the "foot covering", is denoted generally by reference numeral 10. Surgical foot covering 10 comprises an upper portion 12 and a sole portion 14. Upper portion 12 is fixedly attached to sole 14 by means of a first stitching 15 encircling the entire periphery of sole 14.

Figure 2:
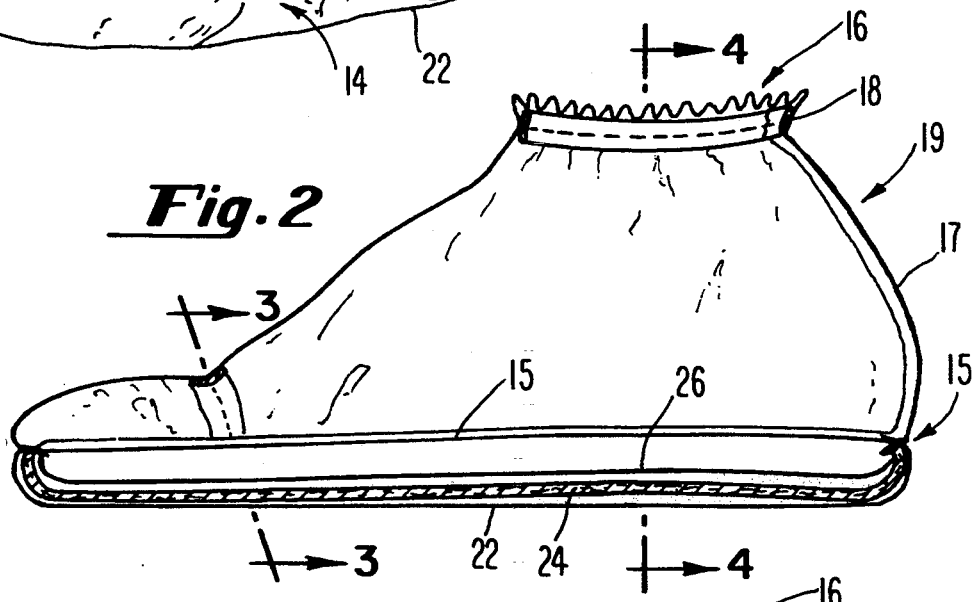
FIG. 2 is a side elevational view taken in section along line 2—2 of FIG. 1.
Figure 3:
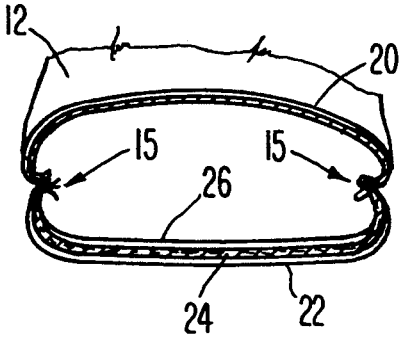
FIG. 3 is a front, elevational view of the toe portion of the foot covering taken along line 3—3 of FIG. 2.
Figure 4:
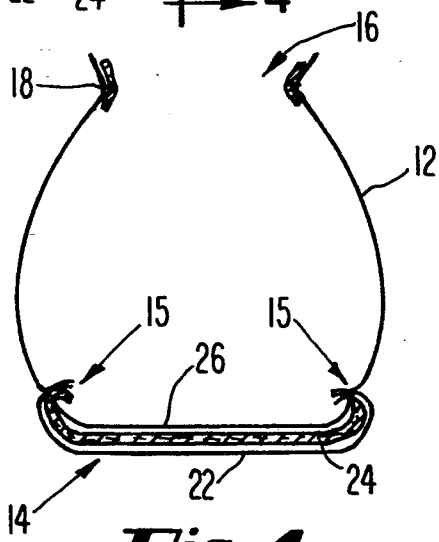
FIG. 4 is an elevational view taken in section along line 4—4 of FIG. 2 showing a cross section of the heel portion of the foot covering.

Upper portion 12 is cut from a single sheet of any suitable material, preferably one which is flexible and soft to the touch, such as a non-woven material which is somewhat water resistant, porous and reasonably durable. Upper portion 12 is provided with a top opening 16 for passage of a foot therethrough. Opening 16 is formed by a second stitching 17 which joins opposite edges of upper 12 at heel 19 of boot 10 beginning at sole 14 as seen in FIG. 2. An elastic strip 18 is sewn to the inside of opening 16 to provide a snug fit to any size ankle. A second elastic strip 20 is sewn laterally across the inside of the toe portion of upper 12, for the purpose of snugly fitting foot covering 10 to the foot.

Sole 14 of foot covering 10 is comprised of three distinct layers of material. The outermost layer 22, which is the portion of foot covering 10 that comes into contact with the floor, is cut from a waterproof plastic material which is durable, flexible, and has non-slip properties to help keep a surgeon from loosing his/her footing while in surgery. The middle layer 24 is made from a non-woven cotton or synthetic cotton such as TIVAC TM style non-woven or KEVLAR woven product. Layer 24 takes away the shock and discomfort of standing on the hard, cold operating room floor by providing a light, resilient layer of cushioning material. The innermost layer 26, which is the portion of foot covering 10 that contacts the bottom of one's foot when the foot covering is donned, is cut from a sheet of terrycloth. The terrycloth provides a material which is comfortable to the wearer, as well as absorbent for purposes of absorbing perspiration from a surgeon's foot.

Sole 14, considered as a whole, provides a surgeon with the sensitivity needed when conducting surgical procedures requiring the use of foot controls. The plastic, outermost sole layer 22 provides protection against liquids soaking through the sole 14 to reach the surgeon's foot as well as significant, yet limited, protection against hazards found on operating room floors from piercing foot covering 10 and injuring the surgeon's foot. The non-woven cotton middle layer 24 and terrycloth layer 26 provide a sole 14 which is ideal for the operating room and especially so for surgeons using sensitive foot controls. While the three layers 22, 24 and 26 have the characteristics described above, they still provide maximum sensitivity between the surgeon's foot and the foot controls needed to operate the foot controls effectively.

What is claimed is:

1. A disposable foot covering to be worn over the bare foot during surgical procedures involving operation of foot controls requiring tactile sensitivity, said foot covering comprising:

a) an upper portion formed from a single ply of non-woven, flexible material resistant to water penetration and defining a lower periphery and an upper opening surrounded by an elastic material to permit insertion of a foot through said opening with a snug fit about the ankle; and b) a sole portion adapted to allow operation of foot controls requiring tactile sensitivity through said sole portion when said sole portion is worn under the bare foot, said sole portion consisting essentially of outer, middle and inner superposed layers having substantially contiguous peripheries joined to and completely about said lower periphery of said upper portion so as to enclose the bare foot, i) said outer layer being formed of a single, contiguous layer of flexible, non-slip, substantially waterproof plastic material, said material having characteristics suitable to provide tactile sensitivity to the bare foot during surgical procedures utilizing foot controls;

ii) said middle layer being formed of a single, contiguous layer of flexible, non-woven fabric material; and iii) said inner layer being formed of a single contiguous layer of flexible, absorbent, cotton fabric material.

2. The foot covering of claim 1 wherein said innermost layer of material is terrycloth.

3. The foot covering of claim 1 wherein said upper portion further comprises a strip of elastic sewn on the inside thereof, laterally across a toe portion, so as to maintain a snug fit of said foot covering about the toes during surgical procedures.

* * * * *